US006382158B1

(12) United States Patent
Durnen

(10) Patent No.: US 6,382,158 B1
(45) Date of Patent: May 7, 2002

(54) TWO-PIECE VALVE COVER

(76) Inventor: Michael R Durnen, 1200 Franklin Mall, Santa Clara, CA (US) 95055

( * ) Notice: Subject to any disclaimer, the term of this patent is extended or adjusted under 35 U.S.C. 154(b) by 0 days.

(21) Appl. No.: 09/698,964

(22) Filed: Oct. 28, 2000

(51) Int. Cl.[7] ..... F01M 9/10

(52) U.S. Cl. ..... 123/90.38; 123/195 C; 123/198 E; 123/90.37

(58) Field of Search ..... 123/90.38, 90.1, 123/90.33, 90.37, 90.39, 193.5, 195 C, 198 E

(56) References Cited

U.S. PATENT DOCUMENTS 4,388,898 A * 6/1983 Larson ..... 123/90.38
4,484,751 A * 11/1984 Deuring ..... 123/198 E
4,498,433 A * 2/1985 Ogawa ..... 123/90.38
4,527,710 A * 7/1985 Lopez-Crevillen ..... 123/195 C
4,593,659 A * 6/1986 Wells et al. ..... 123/90.38
4,601,267 A * 7/1986 Kronich ..... 123/90.33
4,669,432 A * 6/1987 Harada ..... 123/198 E
4,788,950 A 12/1988 Finley ..... 123/195
4,821,699 A 4/1989 Mackin ..... 123/90.38
5,095,860 A * 3/1992 Newell ..... 123/90.38
5,329,898 A * 7/1994 Nelson et al. ..... 123/195 C
5,367,993 A * 11/1994 Tulach et al. ..... 123/90.38
5,868,109 A * 2/1999 Kunzel et al. ..... 123/90.38

* cited by examiner

*Primary Examiner*—Teresa Walberg
*Assistant Examiner*—Fadi H. Dahbour
(74) *Attorney, Agent, or Firm*—Clifford Kraft

(57) ABSTRACT

A two piece valve cover with a removable top cover is constructed of thin gauge material for use on an internal combustion engine having an engine cylinder head and a plurality of valve rocker arms. The cover includes an elongated dome like upper portion which acts as a cover over the rocker arm and cylinder head area of the engine whose external continuous surface does not conform dimensionally with those of a peripheral base flange. A separate peripheral flange portion includes a sealing groove adapted for sealing engagement to the cylinder head through the use of a sealing gasket member. A plurality of apertures through the cover portion can be inserted to secure the cover to rigid flange portion. The outer rim of the top cover is forced into the O-ring groove by the downward action of the cover being attached to the base flange and an outward action of a tapered wedge design of a primary groove, thus forming a seal and the structural rigidity of a one piece product.

18 Claims, 4 Drawing Sheets

TWO-PIECE VALVE COVER

BACKGROUND OF THE INVENTION

This invention relates generally to the field of internal combustion engines and more particularly to a two piece valve cover using a combination of thin and thick gauge materials.

Since the development of the internal combustion engine, there has been a need to cover to seal the valve train from the external environment so as to prevent contamination of the engine and the loss of engine oil. This cover has to be removed occasionally to gain access to the valve train for inspection and/or repair.

Valve covers when formed accomplish two basic functions, one is to act as a cover for the valve train and the other is to have a method of attaching the cover to the cylinder head. Prior technology has only allowed the cover and attaching flange to be formed from the same material as the cover.

Prior technology uses a one piece cover, which can be made by stamping or casting methods well known to the industry with material suitable to be cast or formed in a rigid form suitable for use on an internal combustion engine. Such cover products are then fastened to the cylinder head of the internal combustion engine containing the valve train components along with a gasket material placed between the valve cover flange and cylinder head gasket rail. Prior technology only allowed cast covers to be formed as a two piece unit because of the critical dimensions needed to match top and bottom portions of the valve cover. This two part design has its advantages in some situation, such as racing to help reduce down time.

However, all of the prior valve cover manufacturing methods have their deficiencies. One piece covers that are stamped from thin gauge materials produce a sealing flange that is thin and deforms easily when pressure is applied about the valve cover flange when sealing the gasket to the cylinder head gasket rail. Another deficiency with one piece stamped covers is the time needed to remove and replace valve cover components during periodic inspection or repair. Yet another deficiency for this type of cover is the need to have additional tooling to change the height dimension from short to tall for those situation, such as with some racing engines, that use taller than standard valve train systems. One piece valve covers that are cast from any material suitable for use on an internal combustion engine form a thick rigid cover that is suitable for forming a rigid gasket flange and producing a good seal between the cover and the cylinder head gasket rail, but has the problem of increased weight and cost.

Another deficiency for the one piece cast covers is the same as the stamped one piece cover, i.e., the lack of quick and easy access. Further deficiencies, also present in the stamped version, include the need for additional tooling for a change in dimensions. Casting a two piece valve cover solves the problem of quick and easy access, but still has all the problems of a one piece cast cover plus the addition of added complexity and cost to create a valve cover that is secure and leak resistant when closed.

SUMMARY OF THE INVENTION

A primary object of the present invention is to provide a valve cover for easy and quick access to the valve train without the need to remove or replace a valve cover gasket.

Yet another object of this invention is to allow for a two piece design without using the casting method of manufacture, eliminating the need to maintain critical mating dimensions.

Another object of the present invention is to promote improved sealing over prior technologies.

A further object of the present invention is to provide a valve cover of reduced weight and material cost.

Another object of the present invention is to provide a valve cover that can be easily modified for different height requirements without the need for additional tooling cost and inventory.

Yet a further object is to provide a valve cover without the need to have the top cover permanently attached to base flange for sealing and structural rigidity.

In accordance with a preferred embodiment of the present invention, a two piece valve cover for use on an internal combustion engine having an engine cylinder head and a plurality of valve rocker arms, said cover comprises a flexible top portion having an outer rim, the top portion to cover over the rocker arm and cylinder head area of the engine, a separately constructed base flange adapted for sealing engagement to the cylinder head, said base flange having a generally wedge shaped sealing groove portion for guiding and accepting the outer rim of the top portion.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
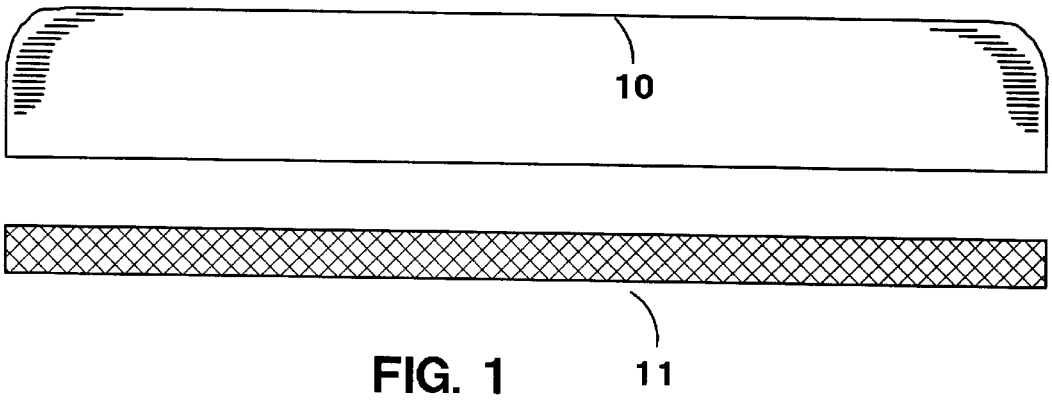
FIG. 1 is a plan view of a preferred embodiment of the invention with top the cover separated from the base flange.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Referring now to the drawings there is shown at FIGS. 5 through 8 valve covers in accordance with generally accepted prior technologies. FIGS. 5, 6, 7, and 8 show common, standard methods of sealing valve cover flanges, 22*a*, 23*a* and 24*a* to a cylinder head gasket rail 20 using a gasket material 19. It is understood these would include fastening devices not shown. In comparison, the base flange 11 of the two piece valve cover of the present invention may use the same method of attaching base flange to cylinder head rail as prior technology, but as described can also be integrated into any cylinder head at time of manufacture.

Figure 5:
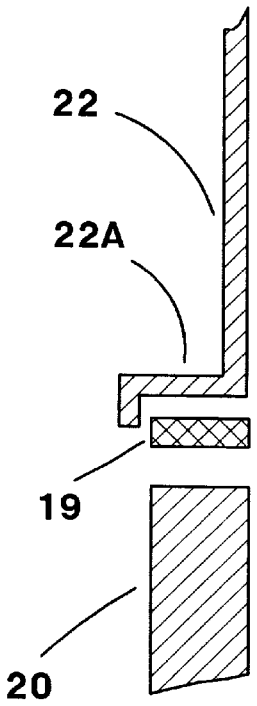
FIG. 5 PRIOR ART
FIG. 5 is a section view of prior technology using stamped thin gauge material for forming a one piece valve cover, along with industry standard sealing method.
Figure 6:
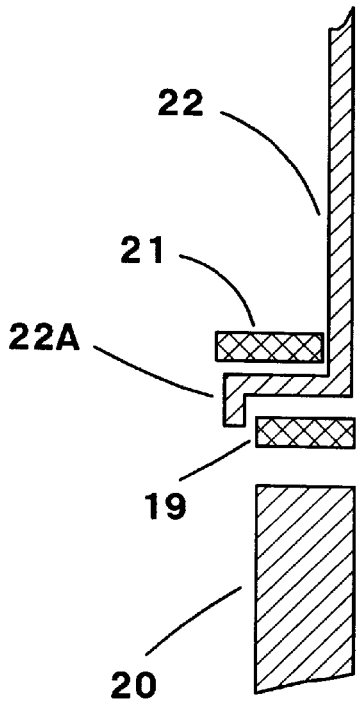
FIG. 6 PRIOR ART
FIG. 6 is a section view of prior technology using thin gauge material for forming a one piece valve cover with the addition of a metal ring to apply even pressure about the valve cover flange, along with industry standard sealing method.
Figure 7:
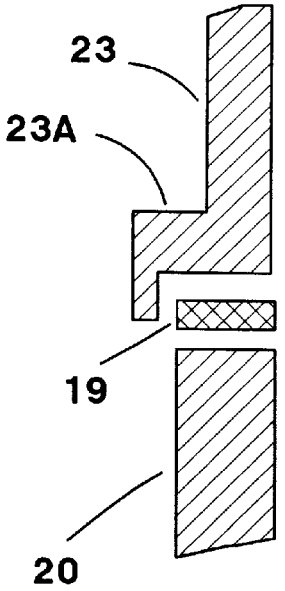
FIG. 7 PRIOR ART
FIG. 7 is a section view of prior technology using cast thick gauge material for forming a one piece valve cover, along with industry standard sealing method.
Figure 8:
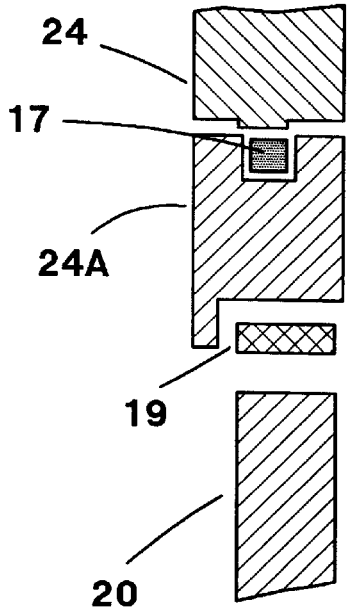
FIG. 8 PRIOR ART
FIG. 8 is a section view of prior technology using cast thick gauge material for forming a two piece valve cover, along with industry standard sealing method.

Further FIG. 5 shows a stamped one piece valve cover using thin gauge material to form top cover 22 with an attached flange 22*a*. FIG. 6 shows the same thing as FIG. 5, except with the addition of the metal ring 21 to distribute pressure about the flange 22*a* to improve sealing of the gasket 19. Also, FIG. 7 shows a cast one piece valve cover resulting in a thicker heavier top cover 23 and an attached flange 23*a*. FIG. 8 shows a cast two piece designed valve cover with top cover 24 being sealed to base flange 24*a* using an elastomeric O-ring 17 seal. This design is too heavy, costly, and complex to be accepted as an alternative replacement for prior valve cover technologies.

Figure 2:
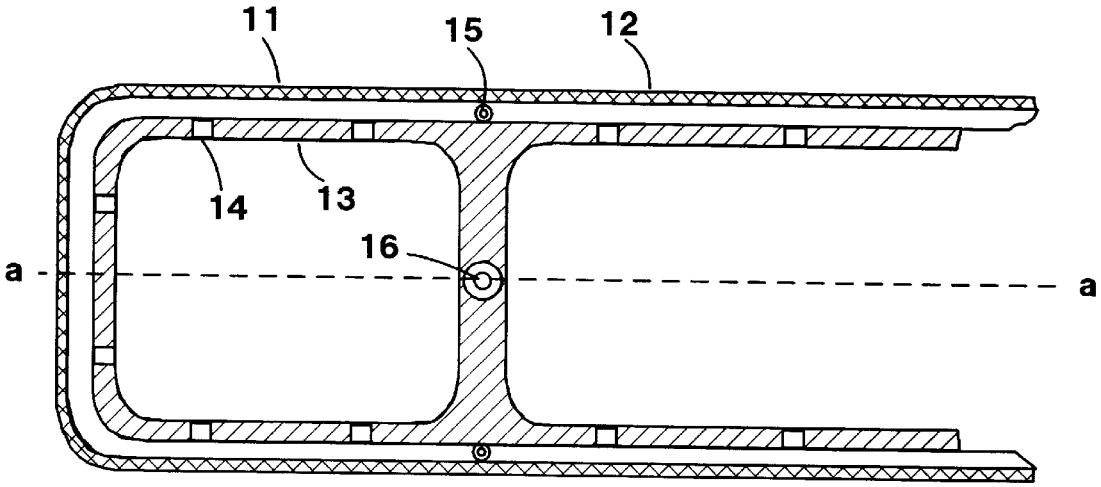
FIG. 2 is a partial top view of the left side of the base flange of FIG. 1.
Figure 3:
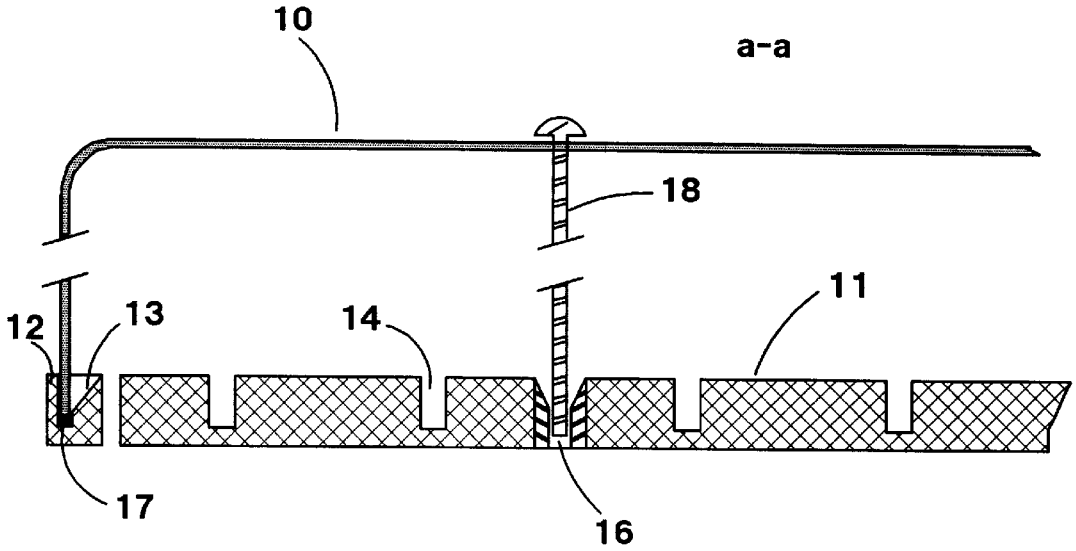
FIG. 3 is a partial side section view along A—A of FIG. 2 with the top portion attached.
Figure 4:
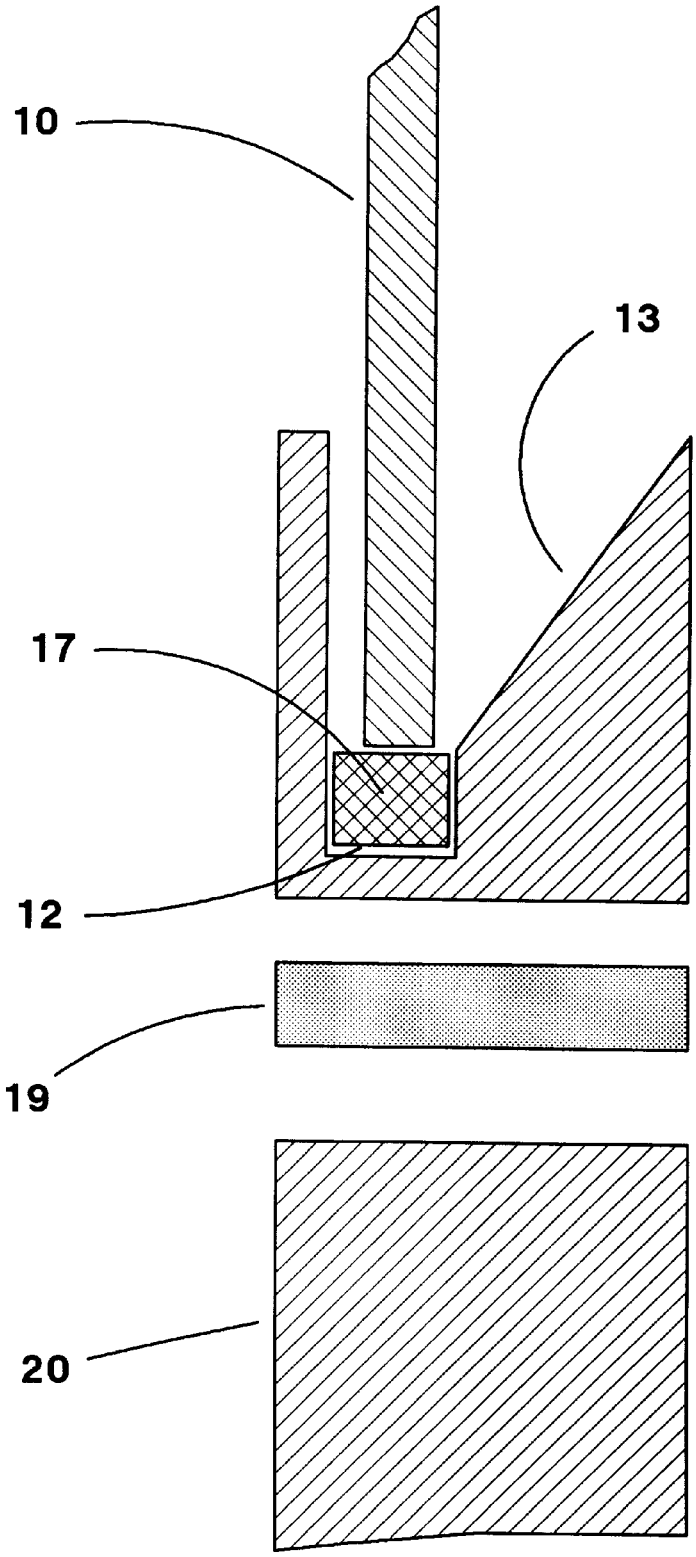
FIG. 4 is a cross-section view of the sealing groove in accordance with a preferred embodiment of the present invention, along with industry standard sealing method containing a gasket and cylinder head sealing rail.

In accordance with the illustrated embodiment of the present invention FIGS. 1, 2, 3, and 4 show the two piece design and construction detailing the sealing groove 12, 13 incorporated in the illustrated embodiment of the invention. FIG. 1 shows top cover 10 separated from base flange 11. FIG. 2 shows in more detail base flange 11 with holes 15 for attaching flange to cylinder head rail 20 (see FIG. 4) and the tapped hole 16 for fastening top cover 10 with one or more fasteners 18 to base flange 11. About the inside perimeter of base flange 11 is a plurality of oil slots 14 to avoid oil accumulating in the sealing groove 12, 13. To accomplish an important function of the invention, there is shown at FIGS. 2, 3, and 4 a wedge shape top groove 13 that allows for the top groove to be wider than the O-ring groove 12 so as to facilitate the initial placement of the outer rim of the top cover 10 to base flange 11. With downward pressure being applied by fastener 18, the outer rim of top cover 10 will be forced outward and downward by the wedge shape 13 into the O-ring groove 12 where it is pressed against O-ring 17 forming a seal and giving rigidity to flexible top cover 10.

This invention uses two separate parts eliminating the need to have the sealing flange portion of the product permanently attached to the cover portion of the valve cover and thus allowing the use of any material for manufacture of the top cover being suitable for use on an internal combustion engine, such as, but not limited to, carbon fiber, aluminum, steel and HI-temp plastic composites and is of a range of 0.030 to 0.070 inches of thickness. The sealing flange portion of the product needs to be formed from materials suitable for producing a rigid member that when attached to the cylinder head has the ability to apply pressure about the gasket member forming the sealing function. The sealing groove may also be formed as an integral part of any cylinder head, thus eliminating the need for the valve cover gasket with its plurality of fasteners. The sealing groove with its wide opening at the top, tapering to a smaller opening for the O-ring groove is what allows thin gauge materials to be easily aligned to the sealing flange prior to being fastened to it.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A two piece valve cover for use on an internal combustion engine having an engine cylinder head and a plurality of valve rocker arms, said cover comprising:

a flexible top portion having an outer rim, the top portion covering the rocker arm and cylinder head;

a separately constructed base flange for sealing engagement to the cylinder head through the use of a sealing gasket member;

said base flange having a generally wedge shaped sealing groove portion for guiding and accepting the outer rim of the top portion.

2. The two piece valve cover as claimed in claim 1, wherein the flexible top portion is made of thin gauge material.

3. The two piece valve cover as claimed in claim 2 further comprising and elastomeric O-ring disposed within said sealing groove portion for forming a resilient seal between said base flange and said flexible thin gauge top cover.

4. The two piece valve cover as claimed in claim 2 wherein said thin gauge material is chosen from the group consisting of steel, carbon fiber, aluminum, and high temperature plastic.

5. The two piece valve cover as claimed in claim 2 wherein said thin gauge material is between 0.020 and 0.100 inches thick.

6. The two piece valve cover as claimed in claim 1 wherein the top portion has one or more apertures through which one or more fasteners can be inserted to secure the top portion to the base flange.

7. The two piece valve cover as claimed in claim 1, wherein said top portion is thin guage material.

8. The two piece valve cover as claimed in claim 1, wherein the base flange further includes at least one oil slots about and inside peripheral of the base flange so as to act as a return path for oil.

9. A two piece valve cover for use on an internal combustion engine having an engine cylinder head and a plurality of valve rocker arms, said cover comprising:

a flexible top portion having an outer rim, the top portion covering the rocker arm and cylinder head;

a separately constructed base flange for sealing engagement to the cylinder head through the use of a sealing gasket member, said base flange having a generally wedge shaped sealing groove portion for guiding and accepting the outer rim of the top portion;

said base flange containing at least one oil return slot about an inside peripheral of said base flange so as to act as a return path for oil not captured by said wedge shaped sealing groove.

10. The two piece valve cover of claim 9 wherein said flexible top portion is made from thin gauge metal.

11. The two piece valve cover of claim 10 wherein said thin gauge material is chosen from the group consisting of steel, carbon fiber, aluminum, and high temperature plastic.

12. The two piece valve cover of claim 10 wherein said thin gauge material is between 0.020 and 0.100 inches thick.

13. A two piece valve cover comprising:

a top covering means for covering a rocker arm and cylinder head of an internal combustion engine;

A base flange means for supporting said top covering means in contact with a gasket, said gasket in contact with said cylinder head;

said base flange means having a wedge shaped sealing groove containing an O-ring, said wedge shape guiding and accepting the outer rim of the top covering means, said O-ring providing a positive oil seal;

a plurality of oil slots in said base flange means to prevent oil from accumulating in said sealing groove.

14. The two piece valve cover of claim 13 wherein said top covering means is made of thin gauge material.

15. The two piece valve cover of claim 14 wherein said thin gauge material is chosen from the group consisting of steel, aluminum, carbon fiber, and high temperature plastic.

16. The two piece valve cover of claim 14 wherein said top covering means is stamped from sheet metal.

17. The two piece valve cover of claim 13 wherein said thin gauge material is between 0.020 and 0.100 inches thick.

18. The two piece valve cover of claim 13 further comprising at least one aperture in said base flange means to receive fasteners for securing said top covering means to said base flange means.

* * * * *